US005948310A

United States Patent [19]

Shon et al.

[11] Patent Number: 5,948,310

[45] Date of Patent: Sep. 7, 1999

[54] MICROWAVE OVEN WITH CIRCULARLY POLARIZED MICROWAVE FEED STRUCTURE

[75] Inventors: Jong-Chull Shon; Eung-Sup Lee, both of Suwon, Rep. of Korea

[73] Assignee: Samsung Electronics Co., Ltd., Suwon, Rep. of Korea

[21] Appl. No.: 09/179,459

[22] Filed: Oct. 27, 1998

[30] Foreign Application Priority Data

Jul. 22, 1998 [KR] Rep. of Korea ..... 98-29500

[51] Int. Cl.[6] ..... H05B 6/72

[52] U.S. Cl. ..... 219/746; 219/748; 219/750; 219/695

[58] Field of Search ..... 219/746, 748, 219/749, 750, 747, 695, 696, 697

[56] References Cited

U.S. PATENT DOCUMENTS 4,301,347 11/1981 Quine ..... 219/748
4,324,968 4/1982 Smith ..... 219/748
4,546,225 10/1985 McCammon ..... 219/749
4,684,776 8/1987 Heard ..... 219/750

FOREIGN PATENT DOCUMENTS 63-279596 11/1988 Japan ..... 219/748

*Primary Examiner*—Philip H. Leung
*Attorney, Agent, or Firm*—Burns, Doane, Swecker & Mathis, L.L.P.

[57] ABSTRACT

A microwave oven for radiating microwaves generated from a magnetron into a cavity to heat and cook foodstuff disposed therein, the microwave oven comprising an antenna disposed between a magnetron and the cavity for converting the microwaves to circularly polarized waves to radiate same into the cavity, the microwave oven having the advantage in that the foodstuff in the cavity is heated by radiation of the circularly polarized waves, thereby enabling a uniform heating of the foodstuff and improving an absorption efficiency of microwave energy.

6 Claims, 9 Drawing Sheets

MICROWAVE OVEN WITH CIRCULARLY POLARIZED MICROWAVE FEED STRUCTURE

BACKGROUND OF THE INVENTION

1. Field of the Invention

The present invention relates to a microwave, and more particularly to a microwave oven for radiating microwaves generated from a magnetron into a cavity to heat and cook foodstuff disposed therein.

2. Description of the Prior Art

FIG. 1 is a schematic sectional view of a microwave oven according to a first embodiment of the prior art, where the microwave oven includes a magnetron 1 and an antenna 2. The antenna 2 is disposed with a waveguide 3 and a feeder holds 4.

The microwave generated from the magnetron 1 is radiated into a cavity 5 via the antenna 2, i.e., via the waveguide 3 and the feeder hole 4, and heats and cooks foodstuff 6.

There are a lot of antennas as illustrated in FIGS. 2*a* and 2*b*, where the antenna in FIG. 2*a* is called a slot antenna 7. The slot antenna 7 is formed such that sides of the waveguide 3 are blocked by conductor plates 9 to which a slot feeder hole 10 is positioned at right angle, where the microwaves generated from the magnetron 1 are radiated into the cavity 5 through the waveguide 8 and the slot feeder hole 10.

However, there is a problem in the slot antenna 7 in that directivity of the microwaves radiated into the cavity 5 is bad due to sudden changes of impedance at the slot feeder hole 10 and narrow area of the slot feeder hole 10.

Accordingly, a known microwave oven has adopted an aperture antenna 11 which (FIG. 2*b*) is an improvement over the slot antenna 7. The aperture antenna 11 has an advantage in that impedance matching between the waveguide 12 free space is good, and directivity of the microwaves radiated into the cavity 5 is excellent. There is another advantage in the aperture antenna 11 in that structure thereof is simple and manufacturing is easy, which is why the aperture antenna is widely used.

The aperture antenna, as illustrated in FIG. 2*b*, is formed with a larger feeder hole 13 than the waveguide 12, such that the microwaves generated from the magnetron 1 are radiated into the cavity 5 via the waveguide 12 and the feeder hole 13.

These types of antenna, as illustrated in FIG. 3, concentrate energy to one direction and radiate microwaves, so that microwave radiation power density in the cavity differ according to directions.

At this time, microwaves emitted to a central front area of the feeder hole at the antenna are called main radiation waves and microwaves radiated at a wider angle then the main radiation waves are called auxiliary radiation waves. The radiation width of the microwaves emitted into the cavity is defined by an angle having the radiation power density of microwaves 3 dB lower than a maximum radiation power density of the microwaves.

An antenna with a good directivity has a radiation width of microwaves emitted into the cavity at 1° and a radiation power density of auxiliary radiation waves is lower by 30 dB to 50 dB than the maximum radiation power density.

Accordingly, in order to obtain an antenna having a good directivity, it is necessary to widen the feeder hole (two sides a and b of the feeder hole) compared with the wavelength of the microwaves. On the contrary, if the feeder hole is small, directivity becomes lower, such that the microwaves emitted into the cavity take a spherical thereby be evenly radiated to all directions in radiation power density thereof.

However, in a microwave oven, an antenna with a poor directivity of microwaves radiated into the cavity obtains a better uniform heating efficiency than that of a better directivity because electromagnetic field distribution in the cavity is even.

Furthermore, microwaves of linearly polarized wave type are emitted into the cavity from an antenna of the conventional microwave oven thus described, as illustrated in FIG. 4, such that the linearly polarized waves proceed with formation of linear polarization.

Still furthermore, molecules in the foodstuff also perform the linear polarization motion when the linearly polarized waves the proceed with formation of linear polarization pass through the foodstuff, as illustrated in FIG. 5. The molecules in the foodstuff thus perform the linear polarization motion to generate heat by themselves and to heat the foodstuff.

However, there is a problem in the conventional microwave oven thus described in that the microwaves radiated into the cavity are linearly polarized waves which proceed with formation of linear polarization, such that molecules of the foodstuff heated and cooked by the linearly polarized waves also performs the linearly polarization motion to thereby reduce an absorption efficiency of energy absorbed by the foodstuff in comparison with the circularly polarized waves.

There is another problem in that the microwave emitted into the cavity which are linearly polarized waves cannot obtain a uniform heating efficiency due to better directivity than the circularly polarized waves.

SUMMARY OF THE INVENTION

The present invention is disclosed to solve the aforementioned problems and it is an object of the present invention to provide a microwave oven adapted to radiate circularly polarized waves to foodstuff disposed in a cavity to heat and cook the foodstuff, thereby heating the foodstuff uniformly and improving an absorption efficiency of microwave energy.

In accordance with the object of the present invention, there is provided a microwave oven for radiating the microwaves generated from a magnetron into a cavity to heat and cook the foodstuff disposed therein, the microwave oven comprising an antenna disposed between the magnetron and the cavity for converting the microwaves to circularly polarized waves to radiate same into the cavity.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiments of the present invention will be described in detail with reference to the accompanying drawings.

Figure 1:
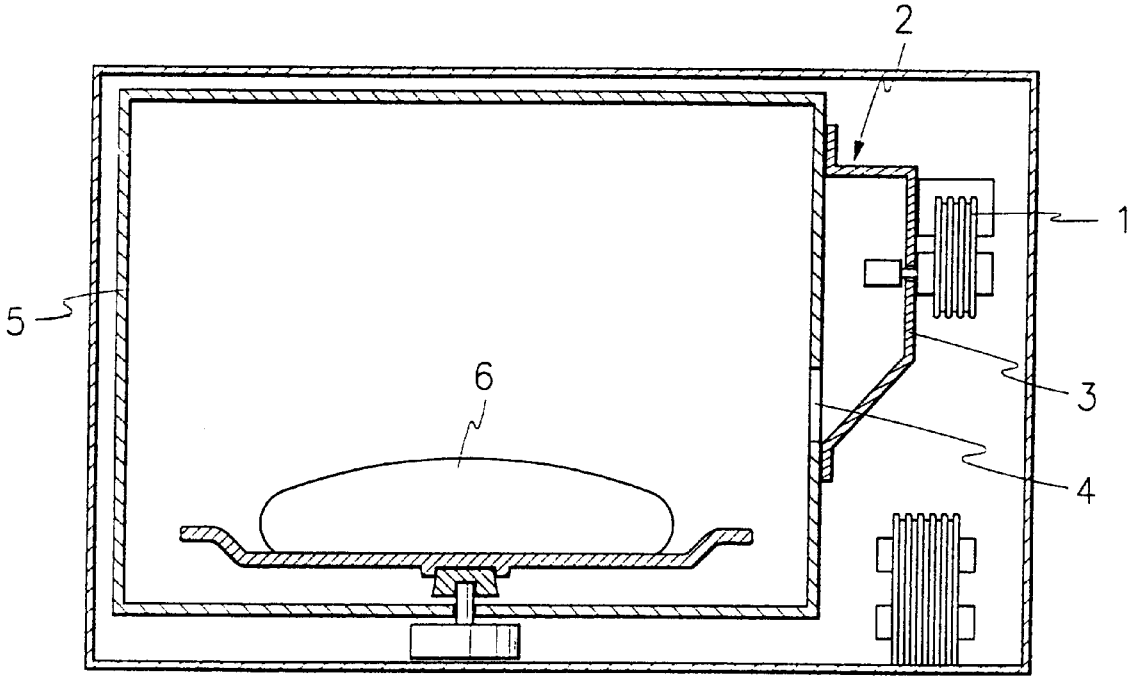
FIG. 1 (PRIOR ART)
FIG. 1 is a schematic sectional view of a microwave oven according to one embodiment of the prior art.
Figure 2A:
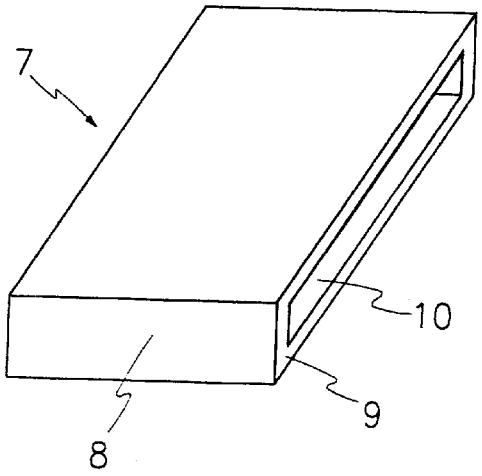
FIG. 2a (PRIOR ART)
FIG. 2*a* is a schematic perspective view of a slot antenna according to the prior art.
Figure 2B:
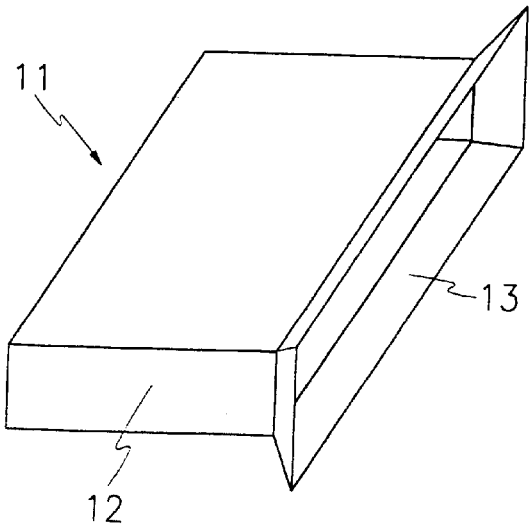
FIG. 2b (PRIOR ART)
FIG. 2*b* is a schematic perspective view of an aperture antenna according to the prior art.
Figure 3:
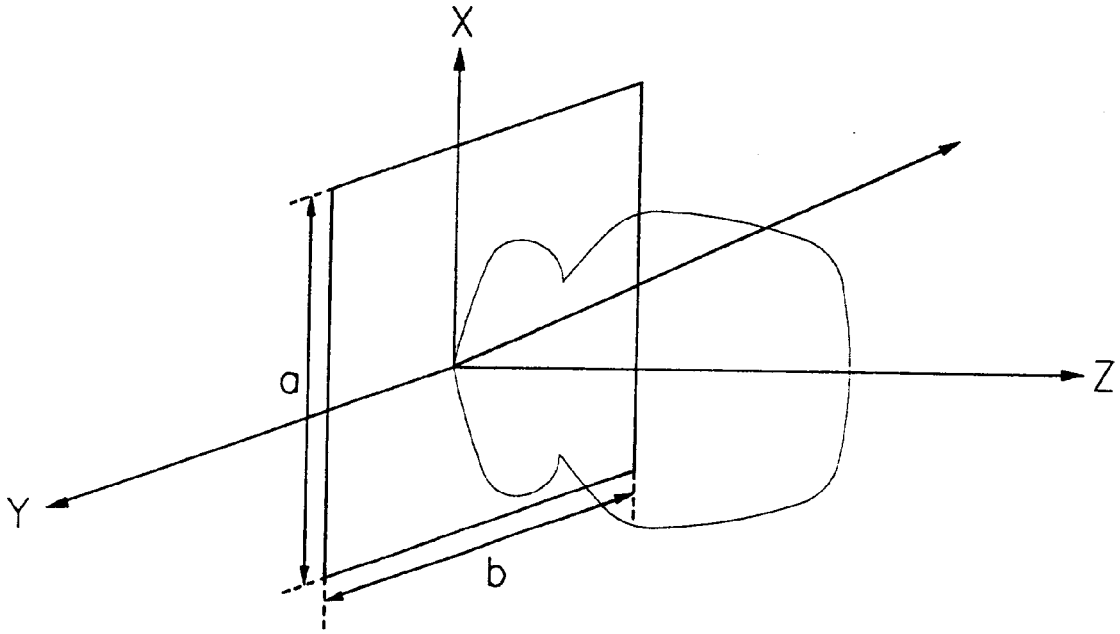
FIG. 3 (PRIOR ART)
FIG. 3 is a schematic diagram for illustrating a radiation pattern of microwaves radiated into a cavity from an antenna of a microwave oven.
Figure 4:
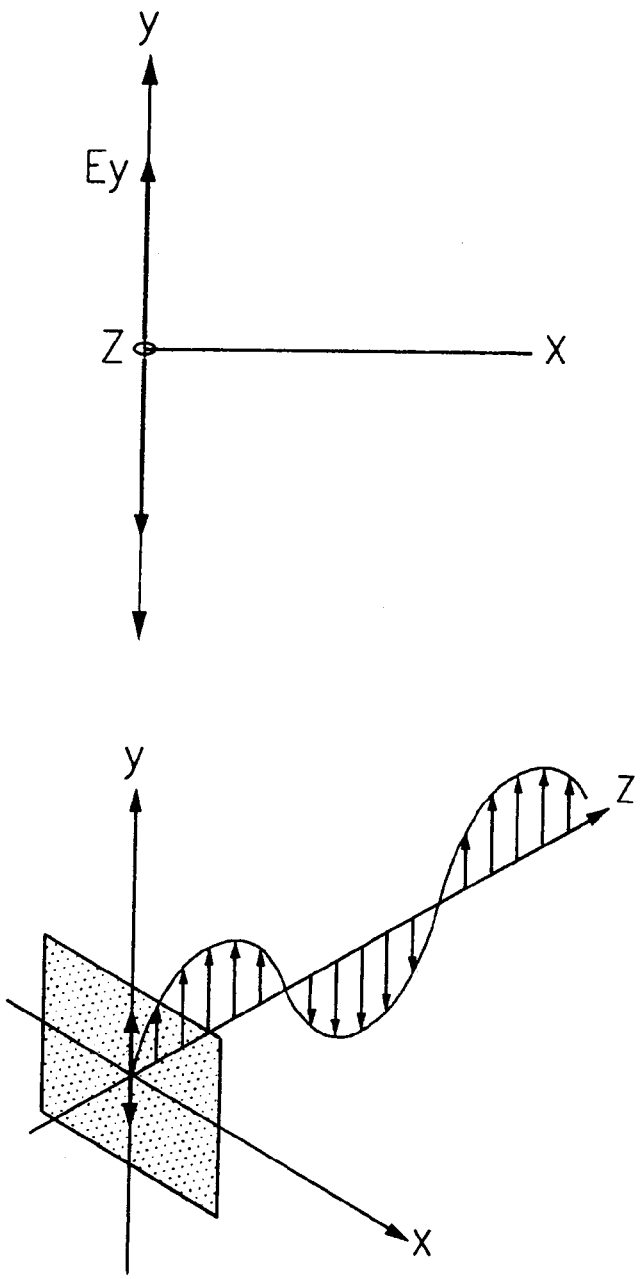
FIG. 4 (PRIOR ART)
FIG. 4 is a schematic diagram for illustrating proceeding shapes of linearly polarized waves.
Figure 5:
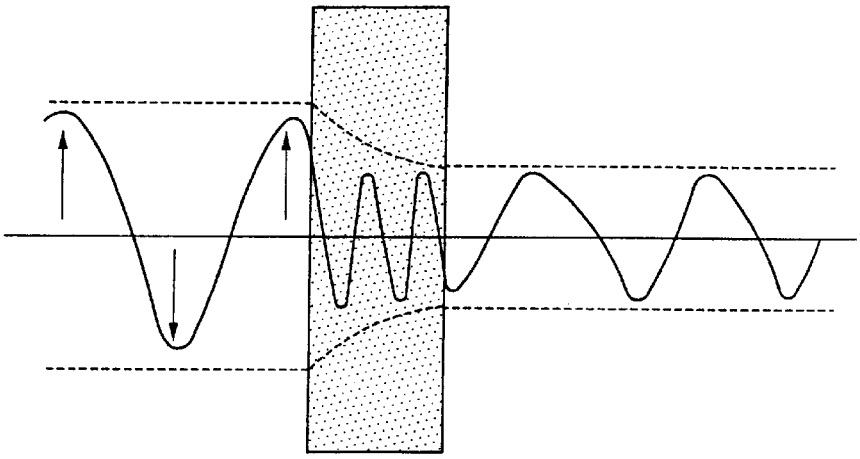
FIG. 5 (PRIOR ART)
FIG. 5 is a schematic diagram for illustrating a foodstuff penetration proceeding route of linearly polarized waves.
Figure 6:
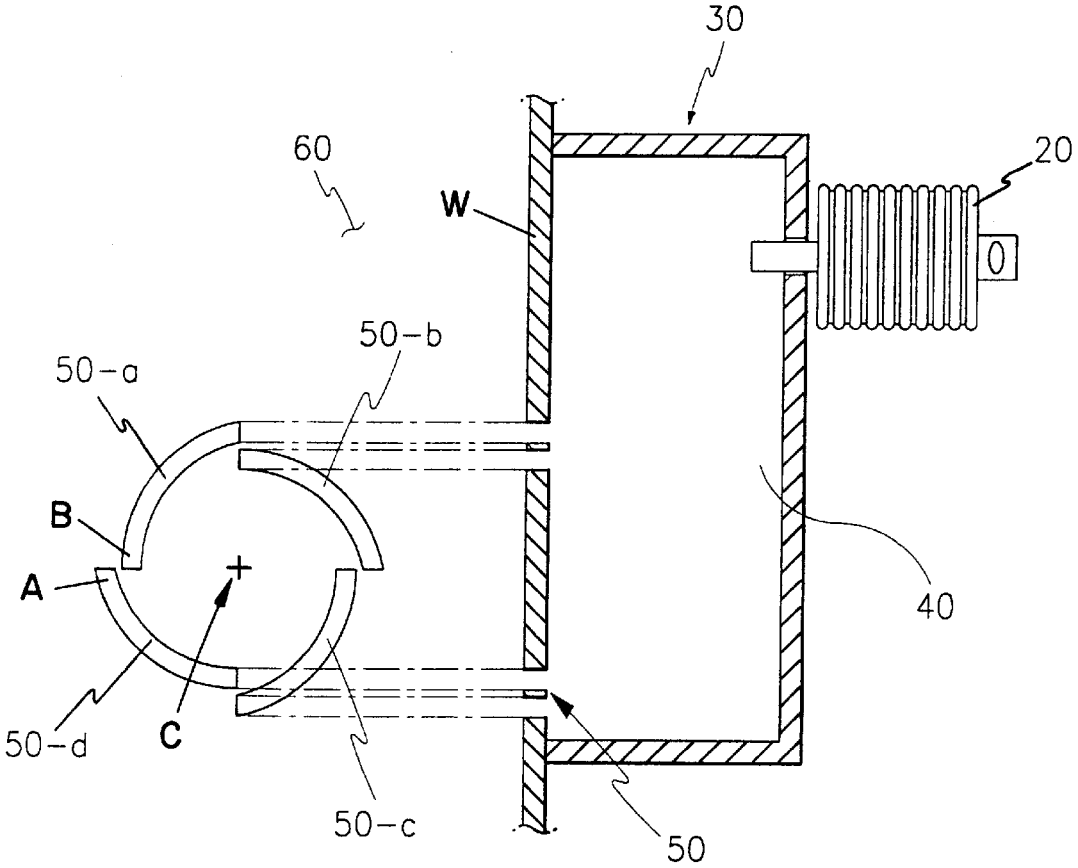
FIG. 6 is a structural diagram of a microwave oven according to a first embodiment of the present invention.

FIG. 6 is a structural diagram of a microwave oven according to a first embodiment of the present invention, where the microwave oven includes a magnetron 20 for generating the microwaves and an antenna 30 for converting the microwaves to circularly polarized waves to radiate same into the cavity 60. The antenna 30 provided with a waveguide 40 for guiding the microwaves into the cavity 60 and a spiral feeder hole arrangement 50 formed in a wall of the cavity 60 for radiating the microwaves into the cavity 60. The spiral feeder hole arrangement 50 is formed with a plurality of feeder holes (50-1, 50-b, 50-c, 50-d), each having a uniform width. An end A of each feeder hole is disposed radially outwardly with respect to an adjacent end B of the next feeder hole. All of the feeder holes are arranged symmetrically with respect to a center axis C extending perpendicularly to the wall W.

Figure 7:
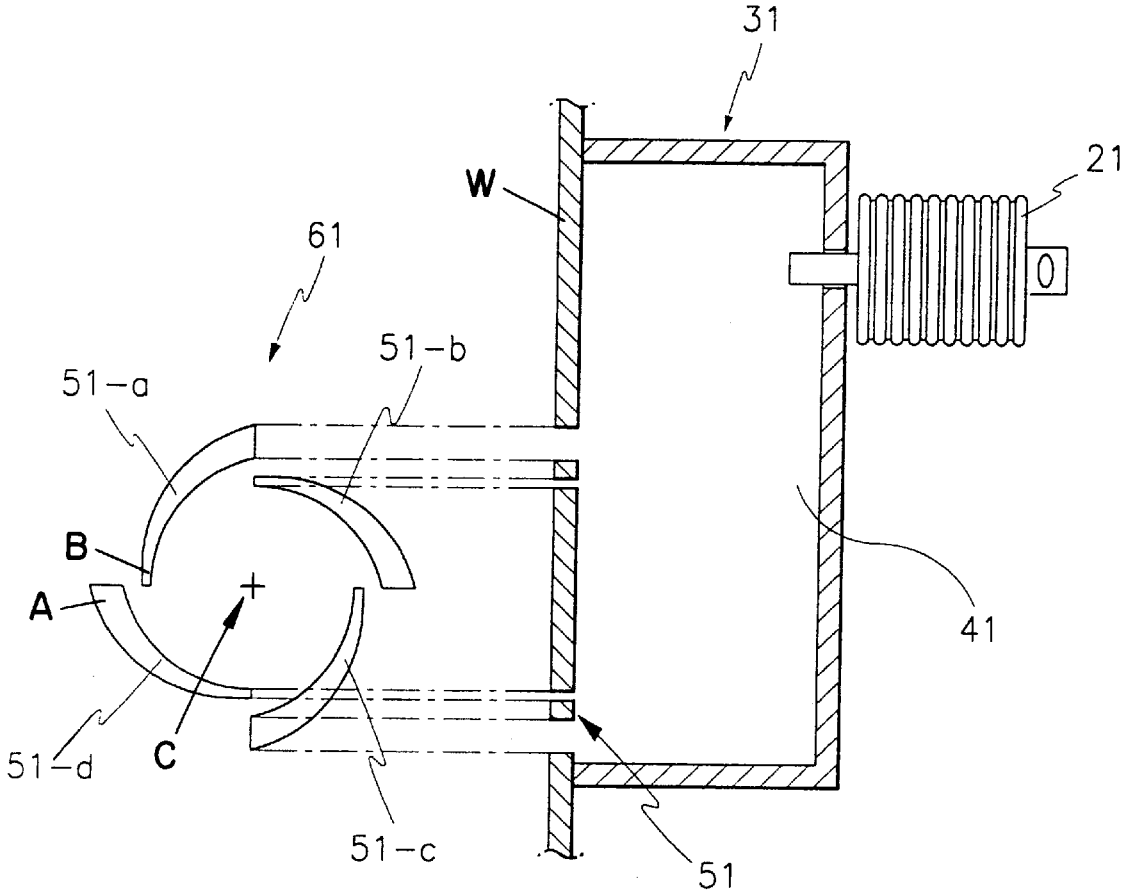
FIG. 7 is a structural diagram of a microwave oven according to a second embodiment of the present invention.

FIG. 7 is a structural diagram of a microwave oven according to a second embodiment of the present invention, where the microwave oven includes a magnetron 21 for generating the microwaves and an antenna 31 for converting the microwaves to circularly polarized waves to radiate same into the cavity 61. The antenna 31 includes a waveguide 41 and a spiral feeder hole arrangement 51 formed on a wall surface of the cavity 61 through which the microwaves are radiated into the cavity 61 guided via the waveguide 41.

The spiral feeder hole arrangement 51 is provided with a plurality of feeder holes (51-a, 51-b, 51-c, 51-d), each having a width that gradually widens as it goes toward a tip end thereof.

Figure 8:
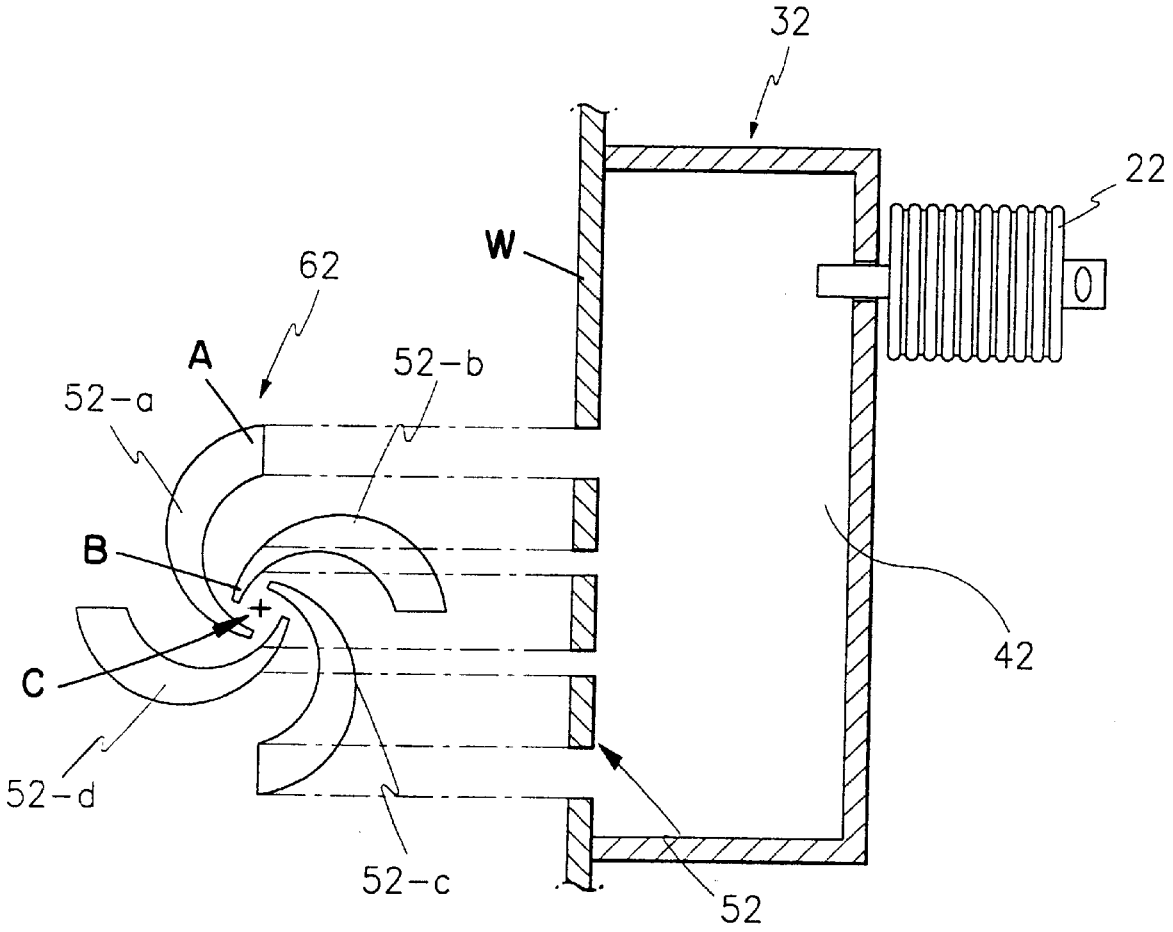
FIG. 8 is a structural diagram of a microwave oven according to the third embodiment of the present invention.

FIG. 8 is a structural diagram of a microwave oven according to a third embodiment of the present invention, where the microwave oven includes a magnetron 22 for generating the microwaves and an antenna 32 for converting the microwaves to circularly polarized waves to radiate same into the cavity 62. The antenna 32 is provided with a waveguide 42 for guiding the microwaves generated from the magnetron 22 into a cavity 62 and a spiral feeder hole arrangement 52 formed on a wall surface of the cavity 62 through which the microwaves guided by the waveguide 42 can be emitted into the cavity 62. The spiral feeder hole arrangement 52 includes a plurality of feeder holes (52-a, 52-b, 52-c, 52-d), each having a width that gradually widens as it goes toward a tip end thereof and having a larger curvature than that of feeder hole arrangement (51-a, 51-b, 52-c, 51-d).

Figure 9:
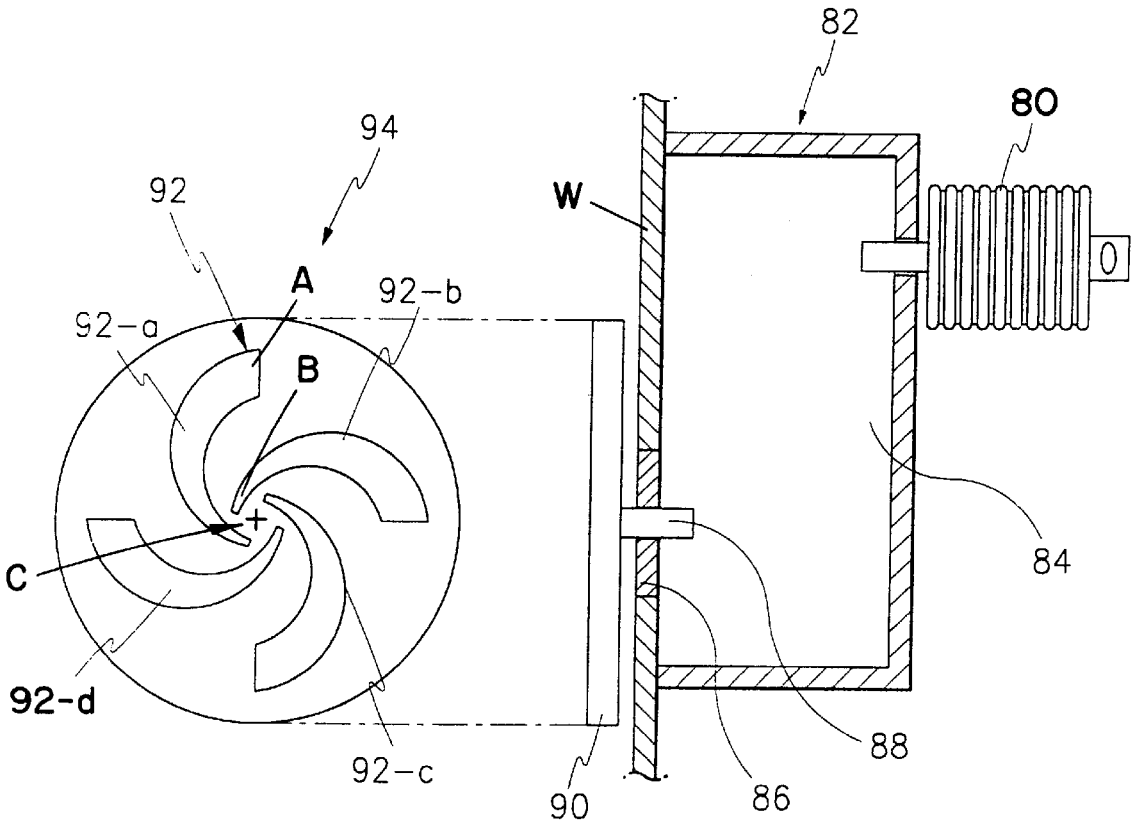
FIG. 9 is a structural diagram of a microwave oven according to a fourth embodiment of the present invention.
Figure 10:
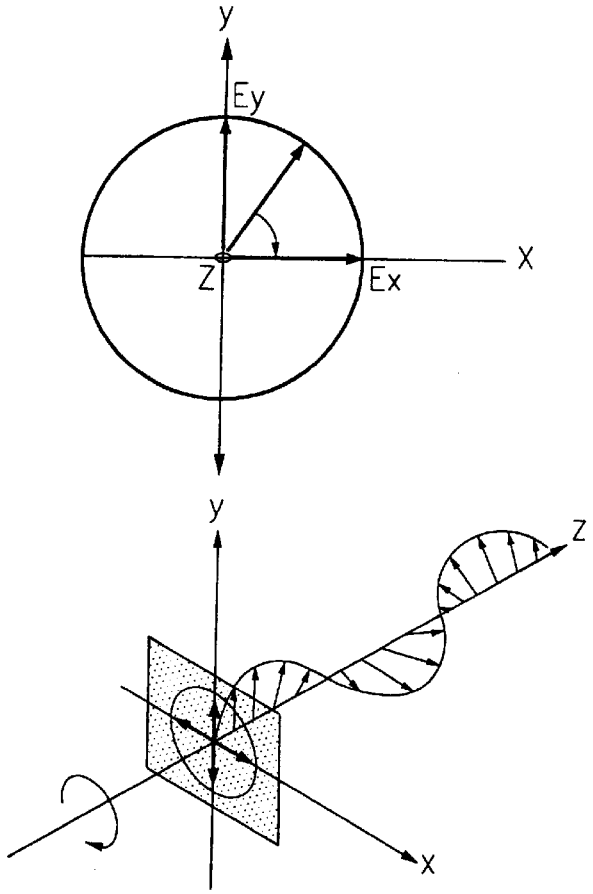
FIG. 10 is a schematic diagram for illustrating a proceeding shape of circularly polarized waves.
Figure 11:
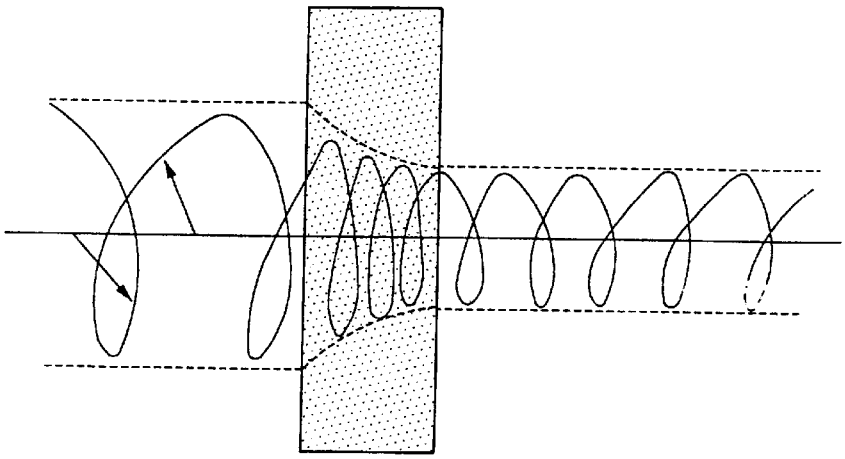
FIG. 11 is a schematic diagram for illustrating a foodstuff penetration proceeding route of circularly polarized waves.

FIG. 9 is a structural diagram of a microwave oven according to a fourth embodiment of the present invention, where the microwave oven includes a magnetron 80 for generating the microwaves and an antenna 82 for converting the microwaves to circularly polarized waves to radiate same into the cavity 94. The antenna 82 includes a waveguide 84 for guiding the microwaves into a cavity 94, a probe 88 inserted into the waveguide 84, a support member made from a material having a low dielectric loss angle, for example Teflon and a disk 90 formed with a spiral feeder hole 92.

The spiral feeder hole arrangement 92 is includes a plurality of feeder holes (92-a, 92-b, 92-c, 92-d), each having a width gradually growing larger as it goes toward a tip end thereof.

Now, an operational effect of the microwave oven thus constructed according to the present invention will be described in detail.

In the microwave oven according to the first embodiment of the present invention, the microwaves generated from the magnetron 20 form standing waves in the waveguide 40 of the antenna 30 and proceeds to be transported to the feeder holes (50-a, 50-b, 50-c, 50-d) of the antenna 30.

At this time, the feeder holes (50-a, 50-b, 50-c, 50-d) are spirally arranged on the wall surface of the cavity 60, such that the microwaves from the waveguide 40 reach the first feeder hole 50-a to be radiated into the cavity 60, and after a predetermined period of time, reach the second feeder hole 50-b and are radiated into the cavity 60 whereby the. According as the microwaves are sequentially radiated into the cavity 60, microwaves form a rotating shape, i.e., circularly polarized waves when viewed from the cavity 60.

In other words, the feeder holes (50-a, 50-b, 50-c, 50-d) perform the function of emitting the microwaves transmitted through the waveguide 40 into the cavity 60 and form the microwaves as circularly polarized waves in shape.

Operations of a microwave oven according to the second and third embodiments of the present invention are omitted, as they are the same as the operation of the first embodiment of the present invention.

Meanwhile, in the microwave oven according to the fourth embodiment of the present invention, the microwaves generated from the magnetron 80 form standing waves in the waveguide 84 of the antenna 82, as illustrated in FIG. 9, and are transmitted via the probe 88 to the disk 90 which is provided with the spiral feeder holes (92-a. 92-b, 92-c, 92-d).

At this time, a frequency of the microwaves generated from the magnetron 80 is changed due to an inner load change of the cavity 94 or an rotation of the turn table, and thus, a frequency of the microwaves transmitted via the probe 88 is changed.

Therefore, the microwaves are radiated into the cavity 94 via the feeder holes (92-a, 92-b, 92-c, 92-d) which are formed at the disk 90, that is, the microwaves are radiated into the cavity 94 through the inner side or the outer side of each of the feeder holes (92-a, 92-b, 92-c, 92-d) of the disc(90 ).

Because the microwaves are sequentially radiated into the cavity 94, they form circularly polarized waves in rotary shape.

In the circularly polarized waves radiated into the cavity, an electrostatic vector circles and changes in a planar arranged surface perpendicular to a processing direction of the microwaves. The circularly polarized wave includes an electrical transversal wave in the form of a circular electrical wave, and a magnetic transversal wave in the form of a circular magnetic wave.

Accordingly, the circularly polarized waves form a rotary polarization with circular electric wave and magnetic wave and proceed, where the circular polarized waves radiated into the cavity are divided into three waves, i.e., circularly polarized waves processing to the foodstuff and circularly polarized waves reflected by the wall surface of the cavity, and circular polarized waves penetrating the foodstuff, among which the circularly polarized waves penetrating the foodstuff have influence to heating of the foodstuff.

At this time, the microwaves heating the foodstuff are composed of electric waves and magnetic waves, where heating of the foodstuff is largely influenced by the electric waves (more than 98%) and is meagerly influenced by the magnetic waves (less than 2%).

Subsequently, the stronger the magnetic field, the higher heat energy is obtained. The heat energy $\{P_{(r)}\}$ thus obtained can be expressed in an electric field function as under.

$$P_{(r)}=5/9\cdot f\cdot \epsilon_r\cdot \tan\delta\cdot|E_r|^2\cdot 10^{10}(W/m^2) \quad \text{[Formula 1]}$$

where, r:distance, $\epsilon_r$:dielectric constant, $f$:frequency, tan δ:dielectric loss angle, $E_{(r)}$:electric field.

Furthermore, electric field (E) of linearly polarized waves can be obtained by Formula 2.

$$|E|=E_0|\sin(wt)| \quad \text{[Formula 2]}$$

where, $E_0$ is a maximum value of electric field.

Accordingly, heat energy $\{P_{(r)}\}$ against incidence of linearly polarized waves is proportionate to $$\frac{|E_o|^2}{2}$$

as expressed in Formula 3.

$$P_{(r)} \propto \frac{|E_o|^2}{2} \quad \text{[Formula 3]}$$

Meanwhile, electric field (E) of circularly polarized waves can be obtained by Formula 4.

$$|E|=E_0 \quad \text{[Formula 4]}$$

where, $E_0$ is a maximum value of electric field. Subsequently, heat energy $\{P_{(r)}\}$ against incidence of circularly polarized waves is proportionate to $|E_0|^2$ as expressed in Formula 5.

$$P(r)\ |E_0|^2 \quad \text{[Formula 5]}$$

Accordingly, energy amount generated from the foodstuff is twice increased for circularly polarized waves, compared with that of the linearly polarized waves.

Furthermore, the circularly polarized waves have omnidirectional directivity in the radiation pattern, such that the circularly polarized waves possess a uniform distribution characteristic in the whole cavity area, thereby obtaining a uniform heating performance, compared with the linearly polarized waves.

As apparent from the foregoing, there is an advantage in the microwave oven according to the present invention, in that foodstuff in the cavity is heated by radiation of circularly polarized waves, thereby enabling a uniform heating of the foodstuff and improving an absorption efficiency of microwave energy.

What is claimed is:

1. A microwave oven comprising:

a cooking cavity;

a magnetron for generating microwaves;

an antenna situated between the magnetron and the cavity for radiating microwaves into the cavity, the antenna comprising:

a waveguide for guiding the microwaves toward a wall of the cavity, and feeder holes formed in the wall for converting the microwaves guided by the waveguide into circularly polarized waves entering the cavity, each curved feeder hole being of curved arc shape and having two ends, the curved feeder holes being arranged in a generally spiral pattern, wherein one end of each feeder hole is disposed radially outwardly with respect to an adjacent end of the next feeder hole.

2. The microwave oven according to claim 1 wherein all of the feeder holes are arranged symmetrically with respect to a center axis extending perpendicularly to the wall.

3. A microwave oven comprising:

a cooking cavity;

a magnetron for generating microwaves;

an antenna situated between the magnetron and the cavity for radiating microwaves into the cavity, the antenna comprising:

a waveguide for guiding the microwaves toward a wall of the cavity, a probe projecting through the wall for transmitting microwaves through the wall, and a disk disposed in the cavity and situated at an end of the probe, the disk including a feeder hole arrangement communicating with the probe for receiving the microwaves and transmitting the microwaves into the cavity, the feeder hole arrangement comprising feeder holes arranged in a generally spiral pattern to convert the microwaves into circularly polarized waves.

4. The microwave oven according to claim 3 wherein each of the feeder holes is curved in the form of an arc having two ends, one end of each feeder hole being disposed radially outwardly with respect to an adjacent end of the next feeder hole.

5. The microwave oven according to claim 4 wherein all of the feeder holes are arranged symmetrically with respect to a center axis extending perpendicularly to the wall.

6. The microwave oven according to claim 3 wherein the disk is mounted on the probe and is spaced from the wall.

* * * * *